US007303298B2

(12) United States Patent
Bhavnani

(10) Patent No.: US 7,303,298 B2
(45) Date of Patent: Dec. 4, 2007

(54) FLASHLIGHT RADIO

(75) Inventor: Dilip Bhavnani, Beverly Hills, CA (US)

(73) Assignee: Sun Coast Merchandise Corporation, Commerce, CA (US)

( * ) Notice: Subject to any disclaimer, the term of this patent is extended or adjusted under 35 U.S.C. 154(b) by 185 days.

(21) Appl. No.: 11/115,519

(22) Filed: Apr. 26, 2005

(65) Prior Publication Data

US 2006/0238998 A1 Oct. 26, 2006

(51) Int. Cl.
*F21V 33/00* (2006.01)

(52) U.S. Cl. ..... 362/86; 362/109; 362/190

(58) Field of Classification Search ..... 362/86, 362/109, 118, 119, 120, 190, 191, 208, 253; 455/74, 344

See application file for complete search history.

(56) References Cited

U.S. PATENT DOCUMENTS

D192,098 S * 1/1962 Bautsch ..... D3/209
4,045,663 A 8/1977 Young
D302,013 S 7/1989 Yuen
D320,600 S * 10/1991 Yuen ..... D26/38
5,313,376 A * 5/1994 McIntosh ..... 362/119
D378,818 S 4/1997 Yuen
6,296,370 B1 * 10/2001 Bamber et al. ..... 362/86
6,315,425 B1 * 11/2001 Confrey ..... 362/86
6,536,917 B1 * 3/2003 Aperocho et al. ..... 362/253
D489,703 S * 5/2004 Tien ..... D26/38

* cited by examiner

*Primary Examiner*—Y. My Quach-Lee
(74) *Attorney, Agent, or Firm*—The Soni Law Firm

(57) ABSTRACT

A combination flashlight audio device wherein the flashlight has an elongated body with an integral mounting flange to which the audio component mounts by way of an attachment means. The streamlined combination may be separated or attached as the audio component is detachable from the flashlight and each of the flashlight and audio component has its own power supply. In addition, for increased functionality, the combination flashlight audio device may further include secondary elements such as a belt clip, a compass or a carabineer.

20 Claims, 4 Drawing Sheets

FIG. 3
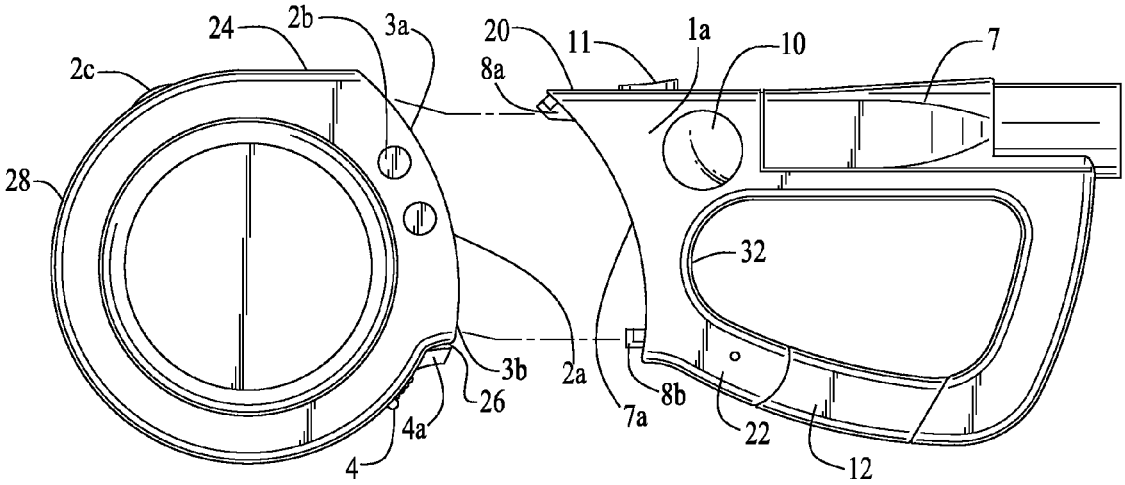
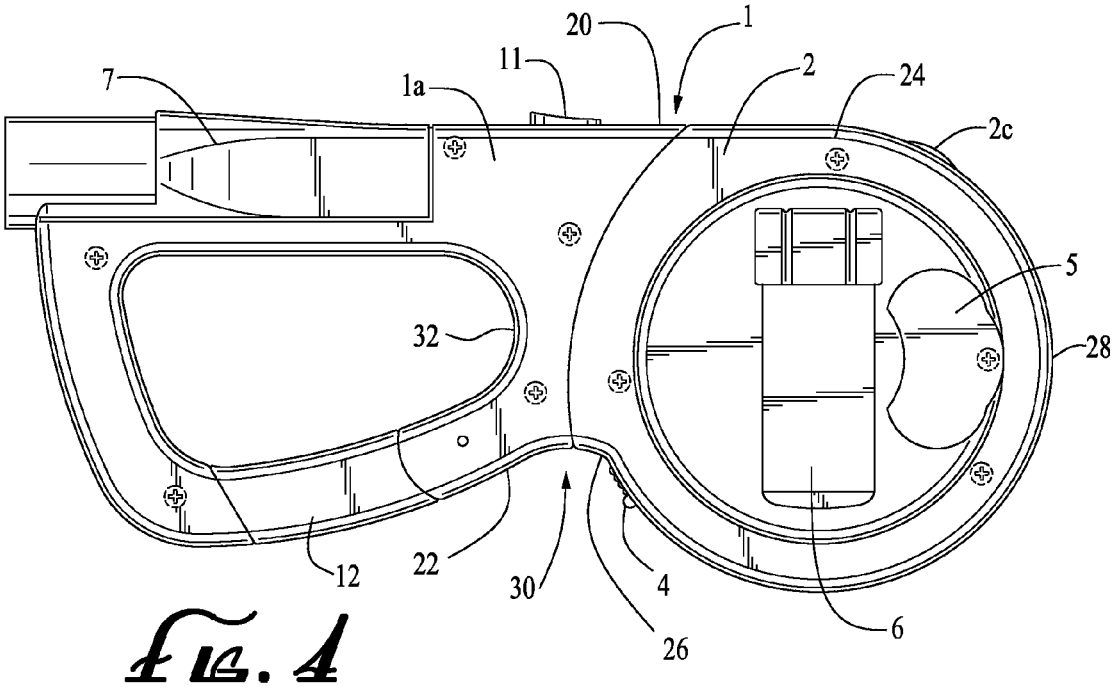
FIG. 4

FLASHLIGHT RADIO

BACKGROUND OF THE INVENTION

The present invention is directed to a singular device capable of numerous different functions in an attached, or assembled configuration, as well as when detached. More precisely, the present invention is directed to a device which is a combination of a flashlight and an audio component. As designed, the invention is directed toward a quick release and attachment mechanism such that the two main elements of the invention, the flashlight and the audio piece, may be readily disassembled and their use concurrently continued.

Flashlight and audio devices are known to typical individual as well as those skilled in the art. The existing devices, however, are lacking in their ability to sustain multi-functional use as either assembled pieces of the product or as separate detached modules. For example, U.S. Pat. No. 4,045,663, to Young describes a combination device that includes both a flashlight and a two way wireless radio. This invention, however, was extremely bulky and provided no description of nor any motivation for a detachable audio component which may be used independently from the flashlight portion of the invention. Moreover, both the flashlight and the radio of the Young invention relied upon the same power source, thereby vitiating any potential separate but concurrent use.

Similarly, U.S. Pat. Nos. D302,103 and D378,181, to Yuen, depict a combination radio and flashlight device. Although no written description is provided therein, both of these inventions purport to be combination devices, again using the same battery power source for flashlight and radio operation. In addition to this common power supply, neither patent includes any means or method by which the radio and the flashlight may be detached or used independently while separated.

Lastly, U.S. Pat. No. D489,703, to Tien, shows a combination device which appears to include a flashlight and radio. While this device does share some similarity of shape with the present invention, there is no similarity of function. The Tien invention also does not have any means for nor suggestion of separability. Similar to those patents described above, the Tien device also appears to rely upon a single power supply to power all the combined components of the invention and it is depicted as a device having a singular housing which is incapable of being detached to create two separately independent devices.

In addition to the discussion above, none of the previously known devices includes a belt clip for attachment to another article or for hands free use. This is primarily due to the larger size and bulky configuration of the preexisting devices, none of which are suited to the highly portable, yet versatile uses of the present invention. Moreover, with the exception of the Tien patent, none of the prior art devices includes a carabineer clip, again attesting to the efficient and compact configuration and size of the present invention.

What is needed is a combination flashlight and audio device which is designed for use as either an attached combination device, but which also may be detached for greater versatility with each of the detached components having its own independent power supply to enable concurrent yet independent use.

What is additionally desired is for the combination device to further include optional elements, such as a hands free clip, a compass and a carabineer ring clip.

SUMMARY OF THE INVENTION

An object of the present invention is to provide a device which is a combination of a flashlight and an audio device. A further object of the invention is to configure the combination device in such a manner that it is compact and yet that each of the included components is independently powered to permit their concurrent use in either the detached or the attached configuration of the invention. Yet another object of the invention is to build upon the compactness and separability of the components by the inclusion of clips, carabineer rings and other elements for the attachment of a component or of the entire combination device to another article. Lastly, an object of the invention is to include other related emergency or adventure related components, such as a compass, within or affixed to the invention.

Each of the above described objects is met by the present invention in its configuration of a combination flashlight and audio device. In a preferred embodiment, the invention comprises an elongated body with the flashlight bulb and lense portion proximate one end and the audio component proximate the opposite end. The audio component would be generally round in this embodiment, with a section of its perimeter having a flange attachment with mating jaws and a release and attachment slide mechanism. This slide is used to lock the audio component to the assembly and in the unlocked position, to facilitate the detachment of same. The audio component further includes a power supply, in this case a set of disc shaped batteries. It would also include the various requisite controls for such a device, whether tuning, volume and the like for a radio or send, receive and other controls for a cellular telephone. The audio component may further include an external speaker in conjunction with or as an alternate to a headphone jack. In the preferred embodiment, the audio component lastly includes a clip on one side, such that it may be attached to the belt or a pocket of its user. The clip thereby permits hands free operation and is positioned whereby when the entire combination assembly is clipped to the user's belt, the flashlight may be oriented to project a beam forward, again to facilitate hands free operation of each of the light and audio source.

The generally rounded attachment flange of the audio component fits into a mating flange face of the flashlight portion of the combination device. In the preferred embodiment, the flashlight portion of the device is a streamlined elongated housing from which the bulb and/or light lense projects from one end. It may also include a compass on one of its external surfaces. The flashlight would incorporate an electrical circuit with a switch serving to close the circuit between the power supply and light so as to illuminate the light. The switch may be one of any type appropriate for operation of the flashlight, such as a pressure switch, a slide or a positive displacement type.

For increased functionality, the flashlight portion may further include some type of clip whereby it may be attached to another article. The most common means of clip would be the popular carabineer type of spring loaded key ring.

BRIEF DESCRIPTION OF THE DRAWINGS

These and other aspects of the invention will now be described with reference to the accompanying drawings, in which:

FIG. 3 is a front side view of a preferred embodiment of the flashlight radio, which depicts the combination device in its partially disassembled configuration with the audio component detached from the flashlight body;

FIG. 4 is a back side view of a preferred embodiment of the flashlight radio, which depicts the combination device in its fully assembled configuration with an optional belt clip on the rear face of the audio component which remains attached to the flashlight body;

DETAILED DESCRIPTION OF THE PREFERRED EMBODIMENT OF THE INVENTION

The accompanying Figures depict embodiments of the present invention, and features and components thereof. With regard to means for fastening, mounting, attaching or connecting the components of the present invention to form the apparatus as a whole, unless specifically described otherwise, such means are intended to at least encompass conventional fasteners such as machine screws, machine threads, snap rings, hose clamps such as screw clamps and the like, rivets, nuts and bolts, toggles, pins and the like. Components may also be connected by friction fitting, snap fitting, adhesives, or by welding or deformation, if appropriate. Unless specifically otherwise disclosed or taught, materials for making components of the present invention are selected from appropriate materials such as metal, metallic alloys, natural or synthetic fibers, plastics and the like, and appropriate manufacturing or production methods including casting, extruding, molding and machining may be used.

Any references to front and back, right and left, top and bottom, upper and lower, and horizontal and vertical are intended for convenience of description, not to limit the present invention or its components to any one positional or spacial orientation.

Figure 1:
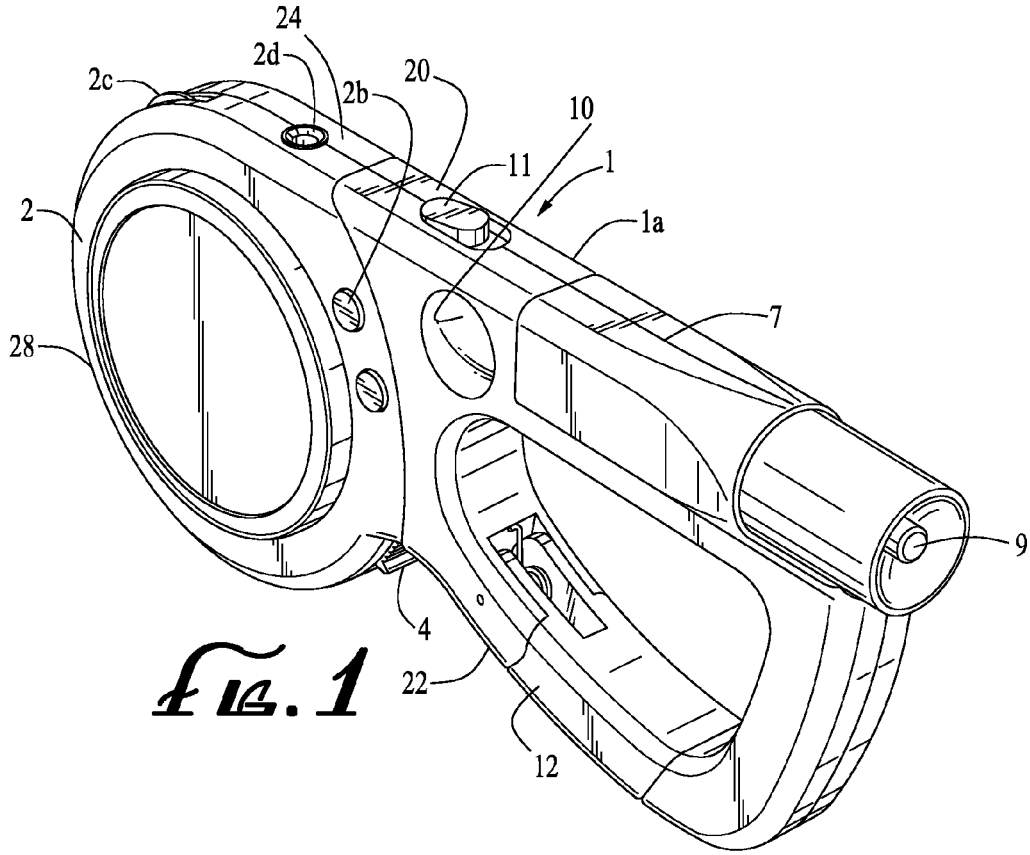
FIG. 1 is a perspective view of a preferred embodiment of the flashlight radio, which depicts the combination device in its fully assembled configuration with the audio component attached to the flashlight body.
Figure 2:
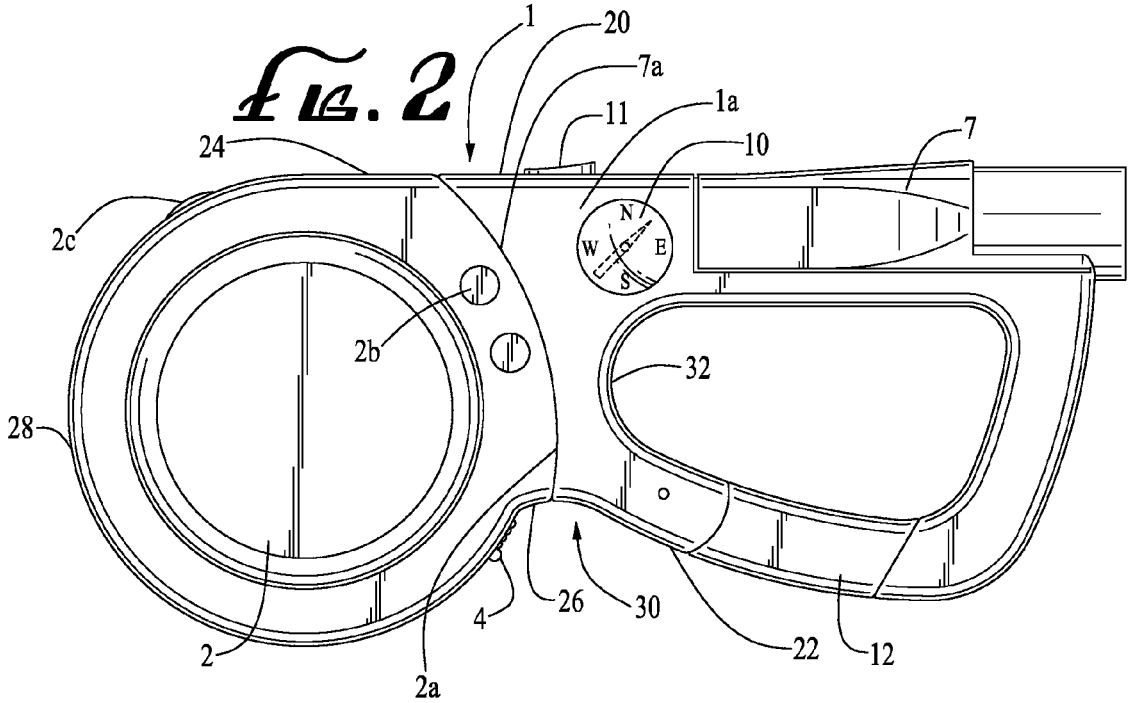
FIG. 2 is a front side view of a preferred embodiment of the flashlight radio, which depicts the combination device in its fully assembled configuration with the audio component attached to the flashlight body.

In a preferred embodiment, the invention comprises an elongated body with the flashlight bulb and lense portion proximate one end and the audio component proximate the opposite end. Referring to FIGS. 1 and 2, the main housing 1 includes a flashlight body 7 and an audio body 2 for the audio component. Although the housing 1 may be constructed of a variety of ferrous, non-ferrous or polymer materials, the most economical means of manufacture would typically be to mold the various housing elements of a plastic or polymer substance. The flashlight body 7 has a first flashlight body edge 20 and an opposing second flashlight body edge 22 and a flange surface 7*a* extending therebetween. The audio body 2 is preferably palm-sized and has a substantially round configuration in this preferred embodiment having a first circumferential audio body edge 24, a second circumferential audio body edge 26, a substantially round circumferential audio body edge 28 extending therebetween, and a flange attachment face 2*a* generally opposing the round edge 28. The audio body 2 includes gripping indentations 3*a* and 3*b* formed on the flange attachment face 2*a* and a release and attachment slide 4 mechanism formed on the round audio body edge 28 adjacent the second audio body edge 26, as shown in FIG. 3. This slide 4 is used to lock the audio body 2 to the assembly and in the unlocked position, to facilitate the detachment of same. The audio body 2 further includes a power supply, in this case a set of disc shaped batteries. As seen in FIG. 4, a cover 5 is provided to access these batteries for change.

Figure 5:
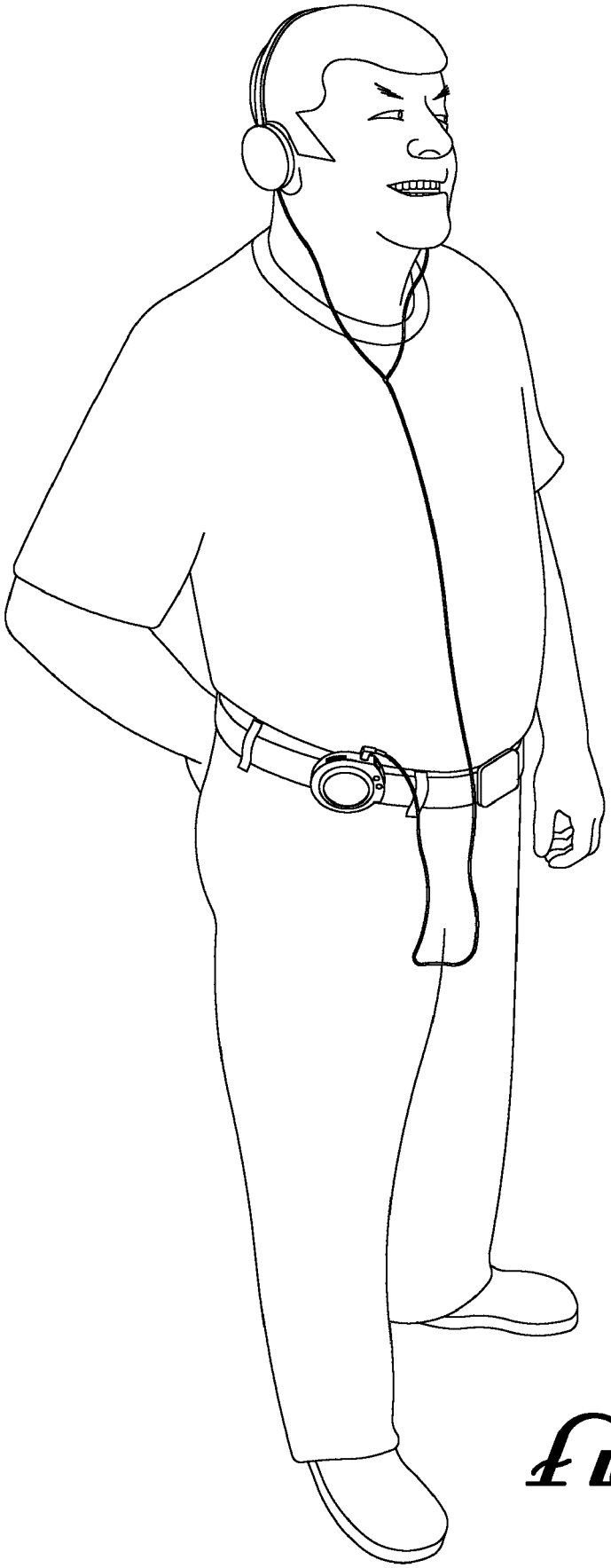
FIG. 5 is a depiction of the device in use by an individual, showing the audio portion as being detached from the flashlight and clipped to the user's belt for hands free operation. In addition, the user is employing optional headphones in order to fully utilize the invention without distraction.

The audio body 2 of the preferred embodiment houses a radio and therefore also includes the various requisite controls for such a device, such as tuning controls 2*b*, volume control 2*c* and an headphone jack 2*d*. While not shown on these drawings of the preferred embodiment, the invention may further include an external speaker of the type well known in the art. In the preferred embodiment, the audio component lastly includes a clip 6 on one side, such that when separated from the flashlight body 7, it may be attached to the belt or a pocket of its user as depicted in FIG. 5. The clip 6 thereby permits hands free operation and is located as shown in FIG. 4 whereby when the entire combination assembly is clipped to the user's belt, the flashlight may be oriented to project a beam forward, again to facilitate hands free operation of each of the light and audio source.

Figure 6:
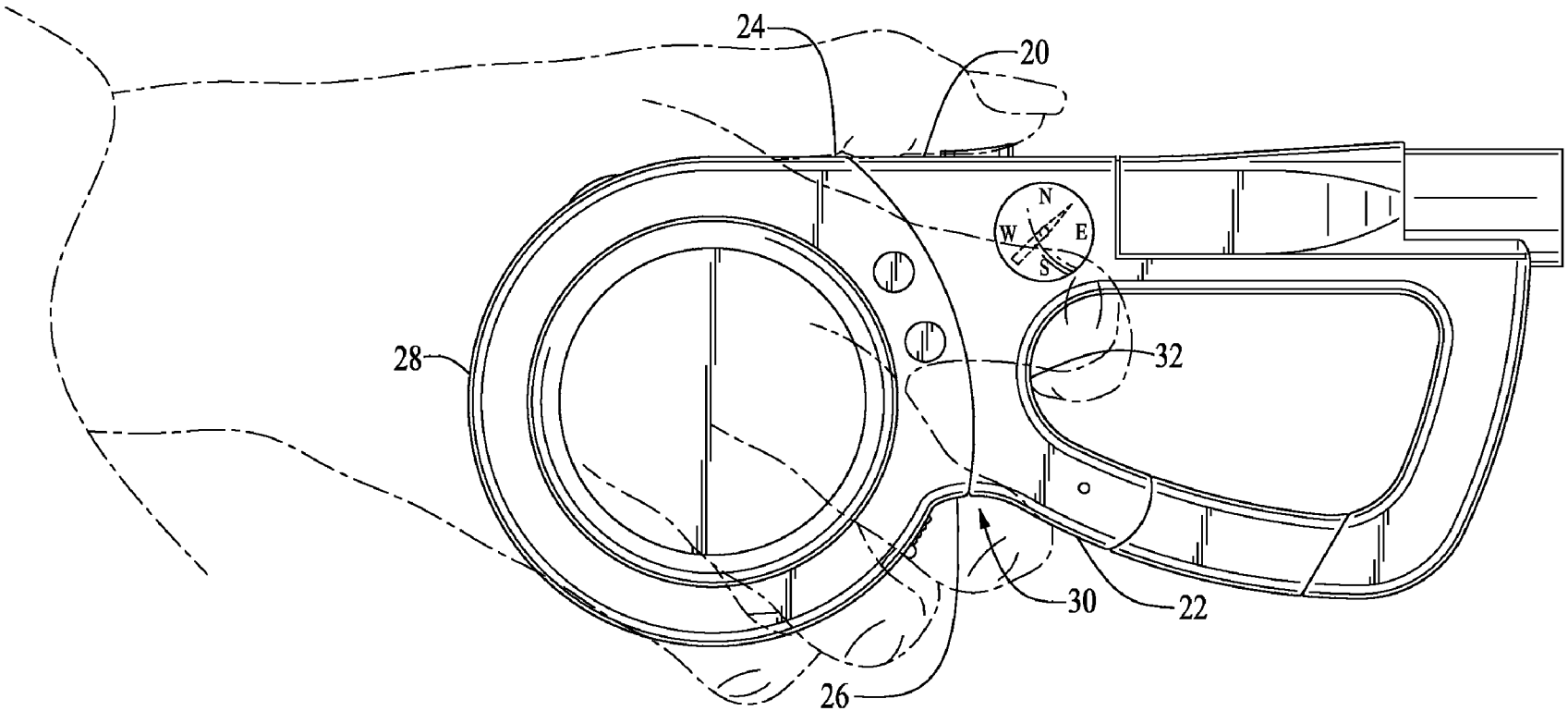
FIG. 6 is a front side view of a preferred embodiment of the flashlight radio held by a user's right hand in an exemplary way.

The generally rounded attachment flange face 2*a* of the audio body 2 removably fits into a mating flange surface 7*a* of the flashlight body 7 of the combination device such that the first flashlight body edge 20 and the first audio body edge 24 are contiguously engaged with each other to define a preferably substantially straight contour, and the second flashlight body edge 22 and the second audio body edge 26 are contiguously engaged with each other to define a concave contour 30 therewith. Those contours together with the particular shapes of the flashlight and audio bodies cooperate to form a pistol-like grip of the flashlight audio device by the user. With such contours, a user can hold the audio body 2 in a pistol-like grip, as depicted in FIG. 6, with the thumb resting on the straight contour defined by the first flashlight body edge 20 and the first audio body edge 24, the middle finger engaging the concave contour 30, and the palm snugly engaging the substantially round audio body edge 28. With such an exemplary way of holding the device, a user can not only hold the device securably and comfortably, but also easily and quickly access other operation controls disposed upon the outer surface of the device, such as a switch 11, without having to change the grip. In the preferred embodiment, as shown in FIG. 3, the flange surface 7*a* further includes a set of gripping jaws 8*a* and 8*b*, which grasp the gripping indentations 3*a* and 3*b* of the flange attachment face 2*a* to as to attach the audio body 2 to the flashlight body 7 of the combination device. As shown, these jaws 8*a* and 8*b* fit into the gripping indentations 3*a* and 3*b*, and when the slide 4 is positioned in the locked position its forward lever arm 4*a* biases against the lower jaw 8*b*, thereby retaining the jaws 8*a* and 8*b* in their locked position in which no movement between the indentations 3*a* and 3*b* and the jaws 8*a* and 8*b* is permitted. In this locked position the bias force of the slide lever arm 4*a* maintains the combination of flashlight body 7 and audio body 2 assembled together. Conversely, moving the slide 4 into its release position by sliding the lever arm 4*a* down and out of contact with the lower jaw 8*b* relieves the bias force against the lower jaw 8*b* and thereby releases the jaws 8*a* and 8*b* from the indentations 3*a* and 3*b* and permits the audio body 2 to be detached from the flashlight body 7. While this jaw 8*a* and 8*b* and indentation 3*a* and 3*b* mechanism is shown and described herein as the preferred embodiment of the invention, the attachment means is not so limited. Any means by which the audio component 2 may be attached and detached from the flashlight body 7 would be within the contemplated scope of the invention. For example, other attachment means may include, but are not limited to, screws, velcro, snap fitting, tabs, push buttons or any other means of attachment.

In the preferred embodiment, the flashlight body 7 comprises an elongated flashlight housing 1*a* from which the bulb 9 and/or light lense projects from one end. It may also include a compass 10 on one of its external surfaces. The flashlight body 7 would incorporate an electrical circuit with a switch 11 serving to close the circuit between the power supply and light so as to illuminate the light or bulb 9. The switch 11 may be one of any type appropriate for operation of the flashlight, such as a pressure switch, a slide or a positive displacement type.

For increased functionality, the flashlight body 7 may further include some type of clip 12 whereby it may be attached to another article. The clip 12 in the preferred embodiment is the popular carabineer type of spring loaded key ring. In such an embodiment, the carabineer typed clip is preferably integrally formed with the elongated flashlight housing 1*a*, defining a clip cavity thereunder. The cavity may define an inner contoured section 32 so that when a user holds the device in the pistol-like grip as described previously, the user's index finger may engage the section 32, as shown in FIG. 6, to provide a further security and comfort to the grip. Any other type of clip, key ring or attachment means, however, may be employed to achieve the flashlight body 7 attachment function if desired.

While the preferred embodiment depicts and describes the audio component as being a radio, the scope of the invention is not so limited. For example, among the known devices contemplated to be within the scope of the audio body 2 of the invention are a radio, cellular telephone, two way radio, cassette player. CD player, CD recorder, MP3 player, DVD player, DVD recorder or a digital audio recording and playback unit. Similarly, while the preferred embodiment describes a compass as a secondary functional piece of the invention, other pieces may be incorporated In or attached to the invention. These pieces or implements may include a screwdriver tip, an awl or other pointed tip, a writing implement, a knife implement a lighter or other igniting implement, or any other implement which may provide increased utility or functionality to the device.

Lastly, it is contemplated that any of the numerous generally flat surfaces of the invention are well suited for and may be utilized for the imprinting of graphical or advertising material for the purposes of advertising or promotion.

What is claimed is:

1. A combination flashlight audio device comprising:

a flashlight component comprising a flashlight body and a first power source encased therein, the flashlight body having opposing first and second flashlight body edges; and an audio component comprising an audio body and a second power source encased therein, the audio body having a substantially round configuration defined by first and second circumferential audio body edges and a substantially round circumferential audio body edge extending therebetween, wherein the flashlight and the audio bodies are removably engaged with each other such that the first flashlight body edge and the first audio body edge are contiguously engaged with each other, and the second flashlight body edge and the second audio body edge are contiguously engaged with each other to define a concave contour therewith, the flashlight and audio bodies cooperating to form a pistol-like grip for receiving a user's thumb upon the intersection of the first flashlight body edge and the first audio body edge, for receiving a user's middle finger upon the concave contour, and for receiving a user's palm upon the substantially round audio body edge, the flashlight and the audio bodies being electrically isolated from each other so as to operate independently when disengaged from each other.

2. The device of claim 1, wherein the audio body further includes a clip attached thereto to be secured thereby to an external article.

3. The device of claim 1, wherein the flashlight body further includes a clip attached thereto to be secured thereby to an external article.

4. The device of claim 1, wherein the flashlight body further includes a carabineer-type clip integrally formed therewith.

5. The device of claim 1, wherein at least one of the flashlight body and the audio body further includes a compass disposed thereon.

6. The device of claim 1, wherein the audio component further includes a female jack for headphone connection.

7. The device of claim 1, wherein the audio component is a radio.

8. The device of claim 1, wherein advertising or graphical material is imprinted on at least one of its outer surfaces for the purpose of advertising or promotion.

9. The device of claim 1, wherein the flashlight and the audio bodies are mateably engaged with each other.

10. The device of claim 1, further comprising a slide-locking mechanism for locking and unlocking the engagement between the flashlight and audio bodies.

11. The device of claim 1, wherein the first flashlight body edge and the first audio body edge define a straight contour at the intersection thereof for providing a comfortable rest for the user's thumb.

12. A combination flashlight audio device comprising:

a flashlight component comprising a flashlight body, a first power source encased therein, and a carabineer-type clip integrally formed with the flashlight body, the flashlight body having opposing first and second flashlight body edges; and an audio component comprising an audio body, a second power source encased therein, and a clip attached to the audio body, the audio body having a substantially round configuration defined by first and second circumferential audio body edges and a substantially round circumferential audio body edge extending therebetween, wherein the flashlight and the audio bodies are removably engaged with each other such that the first flashlight body edge and the first audio body edge are contiguously engaged with each other, and the second flashlight body edge and the second audio body edge are contiguously engaged with each other to define a concave contour therewith, the flashlight and audio bodies cooperating to form a pistol-like grip for receiving a user's thumb upon the intersection of the first flashlight body edge and the first audio body edge, for receiving a user's middle finger upon the concave contour, and for receiving a user's palm upon the substantially round audio body edge, the flashlight and the audio bodies being electrically isolated so as to operate independently when disengaged from each other.

13. The device of claim 12, wherein one of the flashlight body and the audio body further includes a compass.

14. The device of claim 12, wherein the audio component further includes a female jack for headphone connection.

15. The device of claim 12, wherein the audio component is a radio.

16. The device of claim 12, further comprising a slide-locking mechanism for locking and unlocking the engagement between the flashlight and audio bodies.

17. The device of claim 12, wherein advertising or graphical material is imprinted on at least one of its outer surfaces for the purpose of advertising or promotion.

18. The device of claim 12, wherein the flashlight and the audio bodies are mateably engaged with each other.

19. The device of claim 12, wherein the first flashlight body edge and the first audio body edge define a straight contour at the intersection thereof for providing a comfortable rest for the user's thumb.

20. A method of advertising comprising the steps of:

a) providing a combination flashlight audio device comprising:

a flashlight component comprising a flashlight body and a first power source encased therein, the flashlight body having opposing first and second flashlight body edges, and an audio component comprising an audio body and a second power source encased therein, the audio body having a substantially round configuration defined by first and second circumferential audio body edges and a substantially round circumferential audio body edge extending therebetween, wherein the flashlight and the audio bodies are removably engaged with each other such that the first flashlight body edge and the first audio body edge are contiguously engaged with each other, and the second flashlight body edge and the second audio body edge are contiguously engaged with each other to define a concave contour therewith, the flashlight and audio bodies cooperating to form a pistol-like grip for receiving a user's thumb upon the intersection of the first flashlight body edge and the first audio body edge, for receiving a user's middle finger upon the concave contour, and for receiving a user's palm upon the substantially round audio body edge, the flashlight and the audio bodies being electrically isolated from each other so as to operate independently when disengaged from each other; and b) disposing advertising material on a visible outer surface of the device.

* * * * *